US011832675B2

(12) United States Patent
Schneider et al.

(10) Patent No.: US 11,832,675 B2
(45) Date of Patent: Dec. 5, 2023

(54) INSERT FOR A HAT

(71) Applicant: Tenacious Holdings, Inc., St. Paul, MN (US)

(72) Inventors: Nick Schneider, St. Louis Park, MN (US); Dominique Aris, Rolling Hills Estates, CA (US)

(73) Assignee: Tenacious Holdings, Inc., St. Paul, MN (US)

( * ) Notice: Subject to any disclaimer, the term of this patent is extended or adjusted under 35 U.S.C. 154(b) by 139 days.

(21) Appl. No.: 17/475,929

(22) Filed: Sep. 15, 2021

(65) Prior Publication Data

US 2023/0057807 A1 Feb. 23, 2023

Related U.S. Application Data

(63) Continuation-in-part of application No. 29/804,592, filed on Aug. 20, 2021.

(51) Int. Cl.
*A42B 3/12* (2006.01)

(52) U.S. Cl.
CPC ..... *A42B 3/125* (2013.01)

(58) Field of Classification Search
CPC ..... A42B 3/125; A42B 1/08
See application file for complete search history.

(56) References Cited

U.S. PATENT DOCUMENTS

| | | | | | |
|---|---|---|---|---|---|
| 3,440,660 | A * | 4/1969 | Krinke | A42B 1/201 | 2/202 |
| 3,551,911 | A * | 1/1971 | Holden | A42B 3/00 | D29/106 |
| 5,173,970 | A * | 12/1992 | Shifrin | A42B 3/00 | 2/209.12 |
| 5,647,064 | A * | 7/1997 | Whittaker | A42B 1/002 | 2/181.2 |
| 6,266,827 | B1 * | 7/2001 | Lampe | A42B 3/00 | 2/425 |
| 6,751,808 | B2 * | 6/2004 | Puchalski | A42B 3/064 | 2/425 |
| D617,503 | S | 6/2010 | Szalkowski et al. | | |
| D637,356 | S | 5/2011 | Green et al. | | |
| D666,779 | S * | 9/2012 | Harris | D29/122 | |
| D671,271 | S * | 11/2012 | Votel | D29/102 | |
| 9,364,039 | B2 * | 6/2016 | Pusateri | A42B 1/0189 | |
| D769,540 | S | 10/2016 | Meier | | |
| 9,572,390 | B1 * | 2/2017 | Simpson | A42B 3/125 | |
| 9,907,347 | B2 * | 3/2018 | Allen | A42B 3/062 | |
| 10,058,140 | B2 * | 8/2018 | Pusateri | A42B 1/0189 | |
| 10,362,829 | B2 * | 7/2019 | Lowe | A42B 3/128 | |
| D874,069 | S | 1/2020 | Dunton | | |
| 10,791,789 | B2 * | 10/2020 | Creak | A42B 1/201 | |
| 10,905,187 | B1 * | 2/2021 | Bochner | A42B 3/322 | |
| D964,662 | S * | 9/2022 | Votel | D29/102 | |

(Continued)

*Primary Examiner* — Khaled Annis
(74) *Attorney, Agent, or Firm* — Skaar Ulbrich Macari, P.A.

(57) ABSTRACT

A bump cap foam insert for a hat that uses tab and slot structures to form the insert in to a generally conical shape to fit into a hat. The foam insert is constructed by the use of vented radial extensions that extend from a common center and that have a density of about 4 pounds per cubic foot, a thickness of about 0.16" and a tensile strength of about 90 psi.

11 Claims, 4 Drawing Sheets

(56) References Cited

U.S. PATENT DOCUMENTS

2004/0163162 A1* 8/2004 Benziger ..... A63B 23/025 2/413
2009/0222976 A1* 9/2009 Loury ..... A42B 3/322 2/421
2010/0306904 A1* 12/2010 Neid ..... A42B 1/08 2/414
2011/0307997 A1* 12/2011 Blair ..... A42B 3/128 2/414
2012/0047635 A1* 3/2012 Finiel ..... A42B 3/125 2/414
2012/0066820 A1* 3/2012 Fresco ..... A41D 13/0153 2/463
2013/0318690 A1* 12/2013 Cleva ..... A42B 1/08 2/411
2013/0340146 A1* 12/2013 Dekker ..... A42B 3/12 2/411
2014/0020158 A1* 1/2014 Parsons ..... A42B 3/122 2/413
2014/0201885 A1* 7/2014 Rackerby ..... A42B 1/08 2/181
2014/0259312 A1 9/2014 Moore
2015/0013051 A1* 1/2015 Shapiro ..... A42B 3/125 2/421
2015/0264993 A1* 9/2015 Vito ..... A42B 3/20 2/414
2015/0305423 A1* 10/2015 Pusateri ..... A42B 1/08 2/2.5
2016/0000168 A1* 1/2016 Allen ..... A42B 3/08 2/414
2016/0235133 A1* 8/2016 Chase, Jr. ..... A63B 71/10
2017/0105461 A1* 4/2017 Hancock ..... A42B 3/125
2017/0273388 A1* 9/2017 Vito ..... A42B 1/08
2017/0303624 A1* 10/2017 Vito ..... A42B 3/127
2017/0347741 A1* 12/2017 Manera ..... A42B 3/063
2018/0000185 A1* 1/2018 Castro ..... A63B 71/10
2018/0153244 A1* 6/2018 Kirshon ..... B29C 39/025
2018/0192723 A1* 7/2018 Williams ..... A42B 1/08
2018/0235303 A1* 8/2018 Vito ..... A42B 3/08
2018/0279707 A1* 10/2018 Vito ..... A42B 3/127
2019/0090568 A1* 3/2019 Votel ..... A42B 7/00
2019/0090573 A1* 3/2019 Votel ..... A42B 1/08
2019/0166946 A1* 6/2019 Vito ..... A42B 3/127
2020/0000170 A1* 1/2020 Hyman ..... A42B 3/18
2020/0077730 A1* 3/2020 Blaxter, III ..... A42B 1/08
2020/0221806 A1* 7/2020 Vito ..... A42B 3/062
2021/0212403 A1* 7/2021 Vito ..... A42B 3/08
2021/0289872 A1* 9/2021 Fremont ..... A42B 3/125
2022/0022587 A1* 1/2022 Schneider ..... A42B 3/10
2022/0400801 A1* 12/2022 Worple ..... A42B 3/125
2023/0057807 A1* 2/2023 Schneider ..... A42B 3/125

* cited by examiner

INSERT FOR A HAT

CLAIM OF BENEFIT TO PRIOR APPLICATION

This application is a continuation-in-part of U.S. Design patent application Ser. No. 29/804,592, filed Aug. 20, 2021; and such application is hereby fully incorporated by reference herein.

FIELD OF INVENTION

The present invention relates generally to protective headwear. More particularly, the present invention relates to a bump cap insert for a hat.

BACKGROUND

Bump caps are useful for protecting the wearer's head from bumps, cuts and bruises as a result of a wearer moving and making contact with objects such as overhead pipes, low ceilings and other objects. Bump caps are also somewhat useful to protect a wearer's head from falling or moving objects, though such head protection is often much better supplied by hard hats. Bump caps are most often worn under a personal hat, uniform cap, baseball hat or other non-protective headwear. There are many different types of non-protective headwear, such as the so-called trucker's hat, which tends to be of a taller dimension, and a variety of baseball type hats that can be structured, unstructured, low profile and higher profile. There are also a variety of other personal hats, such as Trilby, Fedora, bucket, cowboy and stocking hats.

Because of the variable dimensions of these hats there is a current and unfulfilled need for a bump cap that can be adjusted to accommodate various hat dimensions. Further, most bump cap inserts are made of hard impact-resistant plastic that supply a good degree of bump protection, for example the 6-panel Ball Cap Shell Insert (https://www.zoro.com/erb-safety-shell-insert-6-panel-ball-cap-19402/i/G5062714/). Though these bump caps provide bump protection, they are not easily adjustable to fit different styles and sizes of hats, are often harder and heavier than need be, and provide little in the way of ventilation.

There is an unfulfilled need for a better ventilated, lighter-duty bump cap that provides bump protection while at the same time better accommodating the variable dimensions of different hat styles.

SUMMARY

An EVA foam bump cap insert is disclosed. The bump cap comprises a plurality of radially arranged extensions that radiate from a common center. Each extension is slotted to provide ventilation channels. Further, when the extensions come together during the bump cap assembly and insertion, further ventilation channels are created. Interlocking tab and slot features are located on certain of the radially arranged extensions and are designed to hold the bump cap insert in shape prior to and during insertion into the hat. The tab and slot configuration also allows for shape support and stability of the insert during use. The radially arranged extensions include indicator marks that guide trimming of the insert if needed for a proper fit. The indicator marks also allow for uniform trimming of the insert. The length of the radially arranged extensions is preferably asymmetrical with longer radially arranged extensions located in the areas of the insert facing forward and shorter radially extensions facing rearward. This design better accommodates different hat styles and hair styles. The insert has integrated indicator marks to identify the front and rear of the insert to assist a user during installation of the bump cap insert.

DESCRIPTION OF THE PREFERRED EMBODIMENTS

Figure 1:
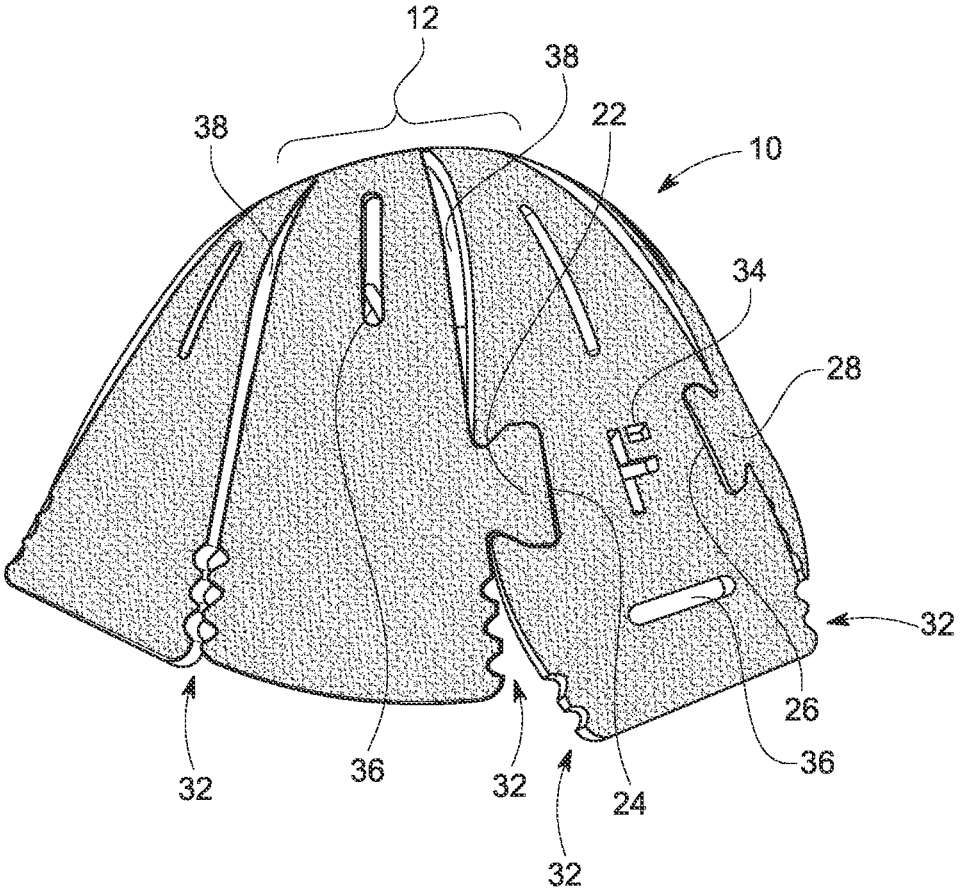
FIG. 1 is a from perspective view of the assembled Insert for a Hat, showing the tab and slot features engaged, venting apertures and the general conical shape.
Figure 2:
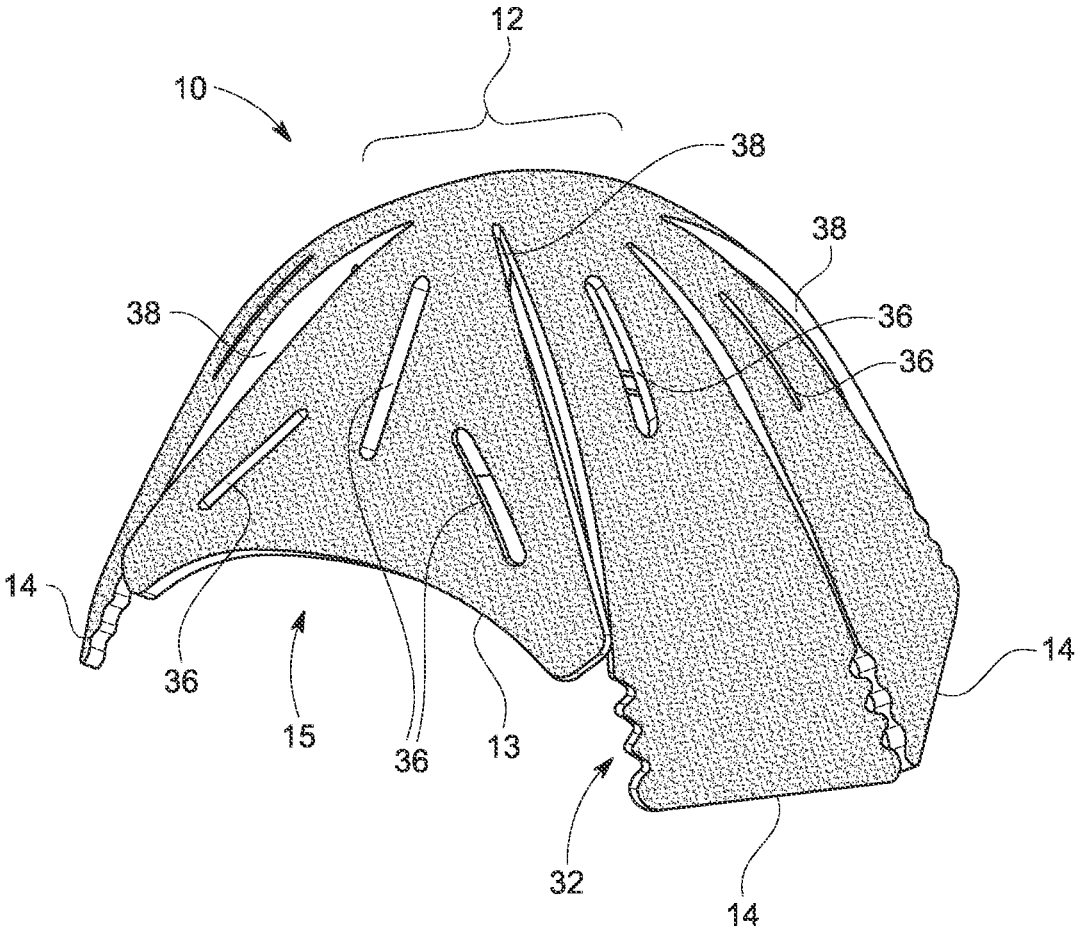
FIG. 2 is a rear perspective view of the assembled Insert for a Hat further showing the asymmetrical rear radial extension and incorporated arch feature.

In a preferred embodiment the insert disclosed herein is made of Ethylene-vinyl acetate (EVA) with a density of about 4 pounds per cubic foot, a thickness of about 0.16" and a tensile strength of about 90 psi. The characteristics of the preferred EVA material may be varied depending on the application environment of the insert. For example, crown portion 12 may be made thicker than one or more of the plurality of radially arranged arms to provide more protection in that area.

Referring to FIGS. 1-4 bump cap insert 10 as disclosed herein is depicted. Bump cap insert 10 comprises a plurality of radially arranged extensions 14 that radiate from a common center 27. Each extension has a plurality of venting apertures 36 to provide ventilation between the wearer's head and the hat into which bump cap insert 10 is placed. When radially arranged extensions 14 come together during the assembly of bump cap 10 for insertion additional ventilation apertures 38 are created.

Figure 3:
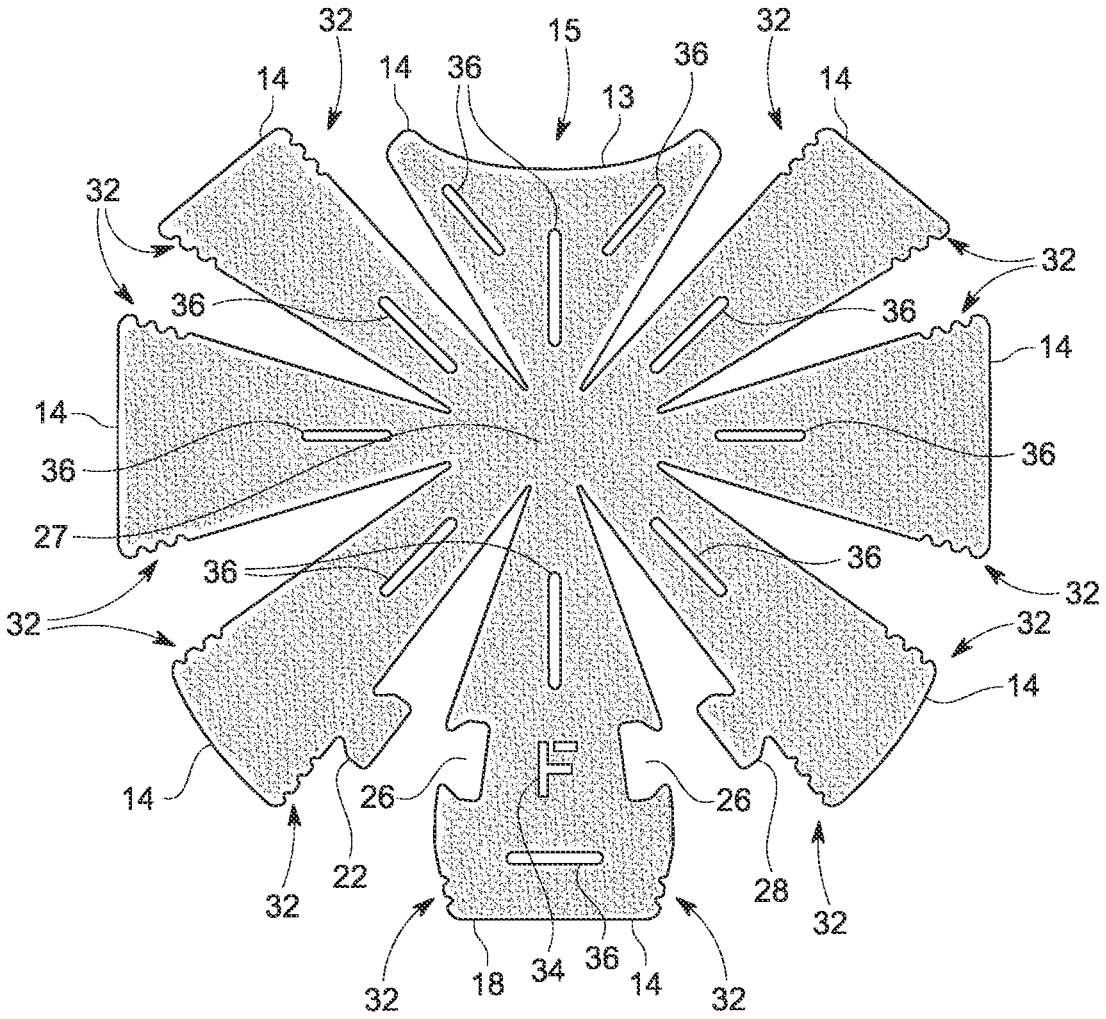
FIG. 3 is a top plan view of an Insert for a Hat in its unassembled state.

In a preferred embodiment, at least two sets of interlocking tabs and slots are employed. As can be seen in FIG. 3, radial extension 16 is configured with tab 22 and radial extension 20 is configured with tab 28. Radial extension 18 defines slot 24 located on its left perimeter and radial extension 18 defines slot 26 on its right perimeter. As can be seen in FIG. 1 when the bump cap insert is assembled tab 22 engages slot 24 and tab 28 engages slot 26. When the tabs and slots are engaged bump cap insert 10 forms a generally conical shape that conforms generally to the shape of a human head. It is contemplated that more than two pairs of tab and slot connectors can be used in the event a more stable structure is needed for certain hat shapes, for example, or certain applications that requires more structural stability is required.

The radially arranged extensions 14 include trim marks 32 that guide trimming of insert 10 if needed for a proper fit into a hat. Certain hat configurations, for example, maybe too short to allow insert 10 to be fully inserted into the hat without insert 10 being visible beneath the edges of the hat. The preferable multiple trim marks 32 located on each radial extension 14 also allow for more uniform trimming of adjacent radial extensions 14. The user may then trim insert 10 to fit the particular hat such that insert 10 is no longer visible. When used with ball style caps, such as cap 40 shown in FIG. 4, it is useful to be able to tuck the lower perimeter 39 of insert 10 into the internal cuff 42 of cap 40 to promote a stable fit. Trim marks 32 are useful to trim insert 10 to insure insert 10 fits into cap 40 and under internal cuff without any bunching of insert 10 to insure a comfortable and stable fit.

Figure 4:
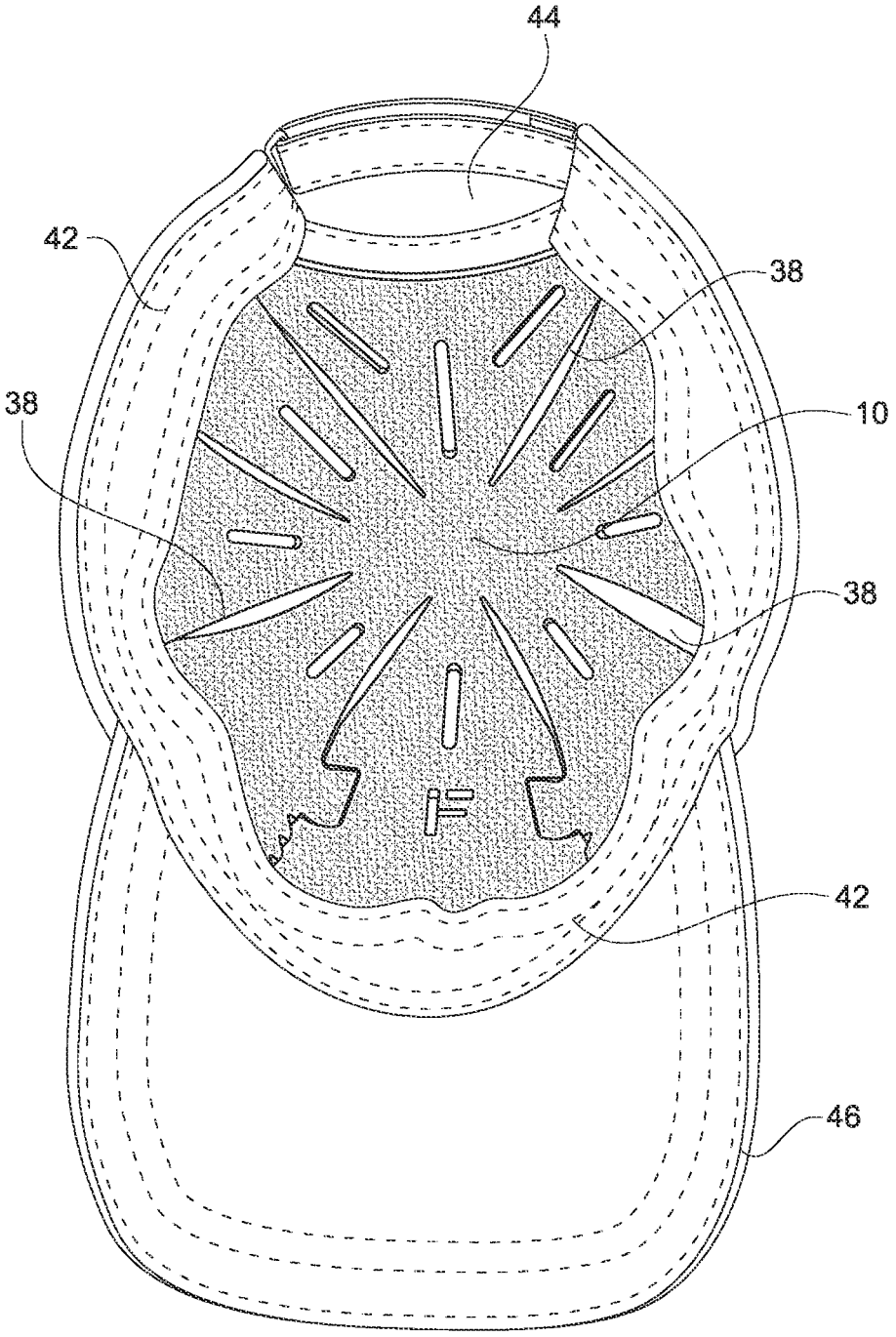
FIG. 4 is a depiction of the fully assembled Insert for a Hat inserted in to a cap.

The length of radially arranged extensions 14 is preferably asymmetrical with a longer radially arranged extension 18 located in the area of the insert facing forward and a shorter radially extension 13 facing rearward. Rearward facing radial extension 13 defines arch 15 to better accommodate different hat styles and hair styles. Referring to FIG. 4, radial extension 13 is preferably shorter, and defines arch 15, so as not to obstruct opening 44 on cap 40. This allows for different hair styles that fit through opening 44 to do so, unobstructed.

Radial extension 18 is marked with indicator 34 to allow a user to orientate radial extension 18 to the front of the hat, as seen in FIG. 5.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A foam insert for a hat comprising:

a front elongated radial extension having a left perimeter and right perimeter, the front elongated radial extension defining a slot on the left perimeter and the front elongated radial extension defining a slot on the right perimeter;

a first side elongated radial extension having a left perimeter and a right perimeter, the first side elongated radial extension being located left of and adjacent to the front elongated radial extension, the first side elongated radial extension having a tab located on the right perimeter, the tab shaped to lock into the slot on the left perimeter of the front elongated radial extension;

a second side elongated radial extension having a left perimeter and a right perimeter, the second side elongated radial extension being located right of and adjacent to the elongated radial extension, the second side elongated radial extension having a tab located on the left perimeter, the tab configured to lock into the slot on the right perimeter of the front elongated radial extension; and, a rear elongated radial extension have a bottom perimeter, the bottom perimeter defining an arch, the rear radial extension have a length that is less than the length of the front elongated radial extension.

2. The foam insert for a hat of claim 1 wherein front elongated radial extension has an orientation indicator.

3. The foam insert for a hat of claim 1 wherein at least one of the front, first side, second side, and rear elongated radial extensions has a plurality of trim marks.

4. The foam insert for a hat of claim 1 further comprising EVA foam that has a density of greater than 3 pounds per cubic foot, a thickness greater than 0.14 inches and a tensile strength greater than 80 psi.

5. The foam insert for a hat of claim 1 wherein the front elongated radial extension has a length greater than the length of the first side elongated radial extension and a length greater than the length of the second side elongated radial extension.

6. A form insert for a hat, comprising:

a plurality of elongated radial extensions that extend from a central crown portion and that have a thickness;

a first of one of the plurality of elongated radial extensions defining two slots, one slot on a left perimeter and one slot on a right perimeter;

a second of one of the plurality of elongated radial extensions having a tab, the tab configured to mate with either of the slots located on the first of one of the plurality of elongated radial extensions; and, wherein when the tab of the second of one of the plurality of elongated radial extensions is mated with the slot of the first of the plurality of elongated radial extensions, the foam insert for a hat forms a conical shape.

7. The foam insert for a hat of claim 6 wherein the thickness of the plurality of elongated radial extensions is less than a thickness of the crown portion.

8. The foam insert for a hat of claim 6 wherein each of the plurality of elongated radial extensions has a length, and one of the plurality of elongated radial extensions has a length less than any of the other of the plurality of elongated radial extensions.

9. A foam insert for a hat, comprising:

a central crown portion;

a front elongated radial extension that extends radially from the central crown portion;

a rear elongated radial extension that extends radially from the central crown portion;

three left side elongated radial extensions that each extend from the central crown portion;

three right side elongated radial extensions that each extend from the central crown portion;

at least two slots configured to receive tabs and defined in at least one of the elongated radial extensions;

at least two tabs configured to mate with the at least two slots, the at least two tabs located on at least one of the elongated radial extensions; and, wherein the front elongated radial extension has a length and the length is longer than a length of any other elongated radial extension.

10. The foam insert for a hat of claim 9 wherein the front elongated radial extension has an orientation indicator.

11. The foam insert for a hat of claim 9 wherein at least three of the elongated radial extension has a plurality of trim marks.

* * * * *